US005087807A

United States Patent [19]

Schreder

[11] Patent Number: 5,087,807

[45] Date of Patent: Feb. 11, 1992

[54] ELECTRIC HOTPLATE

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 652,556

[22] Filed: Feb. 6, 1991

[30] Foreign Application Priority Data

Feb. 13, 1990 [DE] Fed. Rep. of Germany ..... 4004308

[51] Int. Cl.[5] ..... H05B 3/70

[52] U.S. Cl. ..... 219/451; 219/458

[58] Field of Search ..... 219/451, 458, 459, 464, 219/448

[56] References Cited

U.S. PATENT DOCUMENTS 3,021,414 2/1962 Sand ..... 219/451

3,686,477 8/1972 Dills ..... 219/459

4,650,969 3/1987 Kicherer ..... 219/458

4,766,290 8/1988 Schreder ..... 219/458

*Primary Examiner*—Teresa J. Walberg

*Attorney, Agent, or Firm*—Eckert Seamans Cherin & Mellott

[57] ABSTRACT

On the cover of the underside of an electric hotplate is fixed by riveting or the like a lateral connecting plate. A passage or some other functional part is so inserted in the openings of the cover and lateral connecting plate, that it is in each case positively supported on one of the two sheet metal parts by corresponding laterally oppositely displaced projections, so that it is also fixed when the two parts are connected. It forms with the parts a subassembly, which is suitable for automatic hotplate fitting.

12 Claims, 2 Drawing Sheets

ELECTRIC HOTPLATE

DESCRIPTION OF THE PRIOR ART

A conventional hotplate construction (DE-B-26 51 848 corresponding to AU-A-512 394) has on a lower cover a laterally projecting connecting plate, to whose end are fitted connecting means, e.g. an insulator with screw connections. Through an opening in the cover and the connecting plate, which are interconnected in the opening region by wrapping round tongues, projects a passage means in the form of an insulator with passage openings for the connecting leads, which is supported on the underside of the hotplate and is consequently fixed. It is also known in this way to fix other functional components, which pass through the cover, i.e. passage means and e.g. temperature limiters (EP-B-45 007 corresponding to U.S. Pat. No. 4,386,263). The passage means is fixed without support on the inside directly on a cover and without a connecting plate provided thereon by tongues engaging in depressions on the cover plate (DE-A-36 29 549 corresponding to U.S. Pat. No. 4,808,797). There are also passage means which are solely held in position by the connecting leads passing through them (DE-A-26 20 004 corresponding to U.S. Pat. No. 4,122,330).

All these devices function in a satisfactory manner, but require improvements as regards manufacture and fitting. Automatic fitting is in particular prevented in that in certain constructions it is necessary to have two fixing processes, namely for the connecting plate and for the passage means, whilst in other constructions it is necessary to insert and precisely position the passage means, in part prior to the mounting of the cover.

OBJECT OF THE INVENTION

An object of the invention is to simplify fitting and assembly in connection with an electric hotplate.

SUMMARY OF THE INVENTION

As a result of the connection of the cover and the connecting plate, the passage means are positively, i.e. in interlocking manner locked between them. This could take place by a flange enclosed between the plates. However, it is advantageous to bring about locking in one plane by alternating upward and downward support shoulders on projections of the passage means. This construction can be realized particularly simply in ceramic material, e.g. steatite and only requires differently shaped passage openings through the cover and the connecting plate in order to carry out locking in an automatic manner, without stampings and the like being necessary for this purpose.

Thus, the cover, connecting plate and passage means can be combined into a cohesive subassembly prior to the fitting thereof to the hotplate. If the passage means contain bushings for the connecting leads, then said subassembly need only be so inverted over the reversed hotplate that the connecting leads penetrate the openings. A threading of the individual parts and subsequent connection is avoided. As a function of the construction of the passage means, cover and connecting plate the fitting of the passage means can take place from a random side and preferably completely automatically. The connection of the cover and the connecting plate, which simultaneously fixes the passage means, can take place by wrapping round the sheet metal tongues in the marginal area of the openings or by riveting at another point, preferably by extraneous material-free riveting.

SHORT DESCRIPTION OF THE DRAWINGS

These and other features of preferred developments of the invention can be gathered from the claims, description and drawings and the individual features can be realized in an embodiment of the invention and in other fields either singly or in the form of random subcombinations and can represent advantageously, independently protectable constructions for which protection is hereby claimed. Embodiments of the invention are described hereinafter relative to the drawings, wherein show:

FIG. 1 a partial side view of an electric hotplate in the reverse use position.

FIG. 2 a cutout in the cover.

FIG. 3 a plan view of a passage means.

FIG. 4 a plan view of a connecting plate.

FIG. 5 a side view of a passage means.

FIGS. 6 sections along line VI–VII in FIG. 5. and 7.

FIG. 8 a detail section along line VIII in FIG. 4.

FIG. 9 a partial section through the assembly formed.

FIG. 10 a section corresponding to FIG. 9 through a variant.

FIG. 11 a similar section along line XI through a variant.

FIG. 12 a partial plan view of the assembly of FIG. 11.

FIG. 13 a plan view of a connecting plate for a different size passage means.

FIG. 14 a partial plan view of a passage means.

DETAILED DESCRIPTION OF PREFERRED EMBODIMENTS

Figure 1:
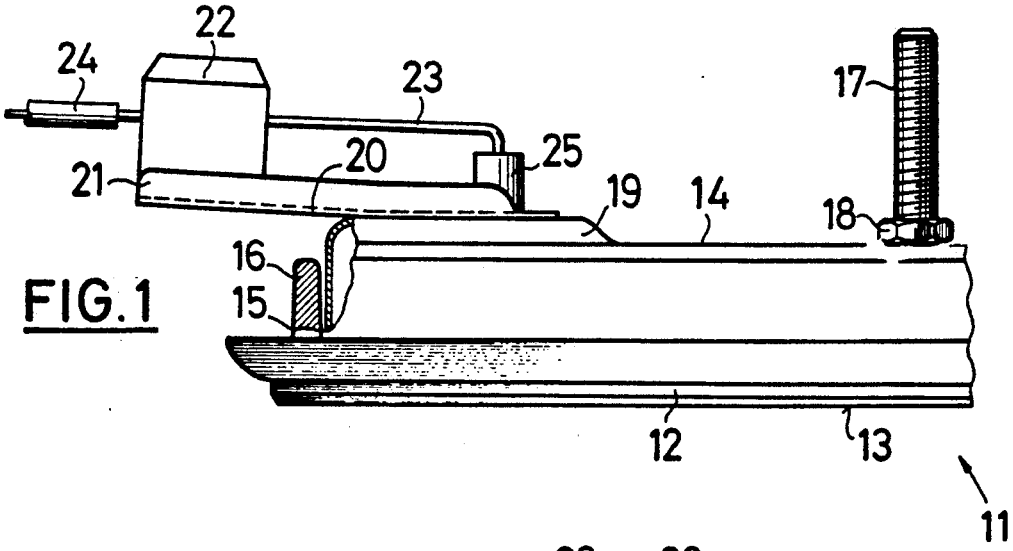

FIG. 1 shows an electric hotplate 11 with a hotplate body 12 and a cooking surface 13 at the top in the use position. The top of the hotplate in the drawings and which is the underside in the use position is closed by a cover 14 made from a profiled sheet metal stamping supported with an outer edge 15 within a cast material edge 16 on the underside of the hotplate, i.e. the embedding of the heating system. Fixing takes place by means of a screwed-in central bolt 17 which, by means of a nut 18, also fixes the hotplate to a hob or cooker. The cover plate can have different designs, e.g. it can rest on the edge 16 or can be centrally fixed by other fastening means.

A connecting plate 20 is fixed to a bulge 19 of the cover 14 and is provided with lateral stiffening upward bends 21 and projects roughly radially outwards from its fixing point, which is relatively far out from the hotplate centre. To its free end is fitted a connecting means 22 in the form of an insulator, which e.g. contains screw terminals, to which can be connected at a point outside the high temperature range solid hotplate connections 23 with current leads 24. The connecting means can contain random connecting devices, such as plug connections, etc. and/or can receive temperature sensors, etc., which are connected to the hotplate or its leads.

Figure 9:
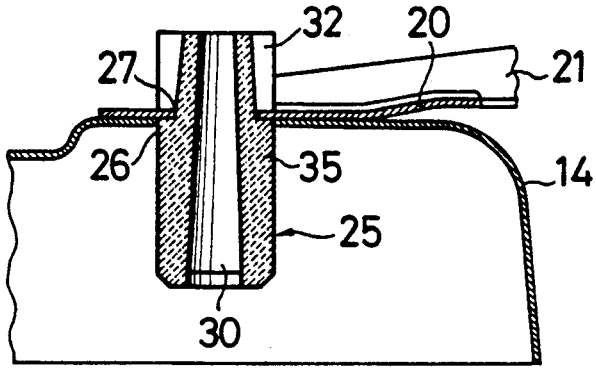

At the hotplate-side end of the connecting plate 20 the connecting lead 23 project through the passage means 25 constructed as a body made from heat-resistant insulating material, e.g. steatite or other ceramic materials. It projects through the openings 26,27 in the cover 14 and the connecting plate 20 and is consequently fixed (FIG. 9).

Fixing is illustrated by FIGS. 2 to 8. The opening 26 in the cover 14 is shaped like a slot, which is provided at its two longitudinal sides with in each case a widening cutout 28.

The opening 27 in the connecting plate 20 has an elongated, rectangular shape with rounded corners having a greater width than the slot dimensions of opening 26 in the marginal area and projecting portions 29 in the median longitudinal area, so that the opening 27 is narrower there than the opening 26 in the vicinity of the cutout 28.

The shape of the passage means 25 can be gathered from FIGS. 3 and 5 to 7. It is a relatively narrow body, in which there is a row of four circular passage openings 30, which widen downwards in funnel-shaped manner and have insertion bevels. In the upper region in the drawing (at the bottom in the use position) flange-like projections 32 are provided on the narrow sides 31 and their undersides form support shoulders 33. They only extend slightly into the vicinity of the longitudinal sides 34, in whose central area a projection 35 is provided on either side and extends upwards from the other side (underside in the drawing) and in a plane with the support shoulders 33 also has its upper boundary forming a support shoulder 36. In addition, in the vertical area of the projections 33 following onto the projection 35 is provided a slight depression 37 of the longitudinal sides 34. The shape of the passage means can also be gathered from the sections taken in different planes according to FIGS. 6 and 7.

Figure 4:
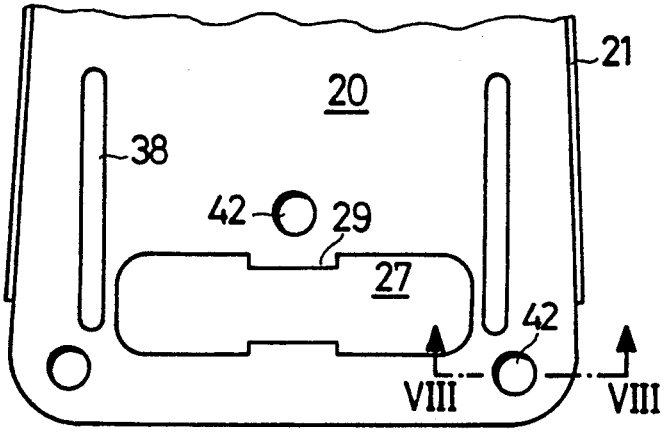
Figure 7:
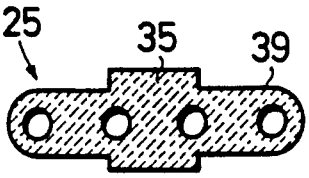
Figure 8:
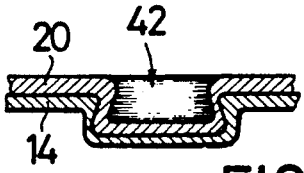

The shape of the connecting plate 20 in the vicinity of the openings can be gathered from FIG. 4. It is slightly trapezoidally widened in the opening region and has stiffening corrugations 38 in addition to the stiffening upward bends 21.

The shape of the openings 26,27, in conjunction with that of the passage means 25 is selected in such a way that the following assembly and fitting procedure is possible. The passage means 25 can be introduced from above into the opening 26. The lower part of the body 39 of the passage means and the two-side projections 35 pass through the opening 26, (i.e. the portion shown in cross-section in FIG. 7) until the narrow side marginal regions 40 of the opening 26 engage on the support shoulders 33.

Subsequently the connecting plate 20 is placed from above over the passage means, which is possible because it is cutout correspondingly large in the vicinity of the projections 32. It is supported with its projecting portions 29 on the support shoulder 36 of the projection 35, so that there is now a support on in each case one of the two sheet metal parts 14,20 in opposite directions, as a result of the oppositely directed support shoulders 33,36.

Figure 10:
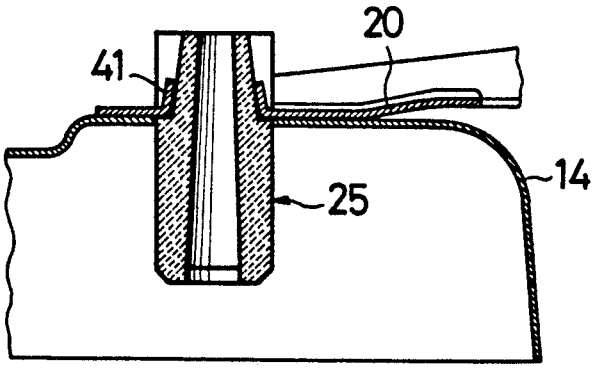

Lateral guidance is brought about by adapting the cross-sectional shape of the passage means 25 and the openings 26,27 and an even better lateral guidance and insertability can be achieved according to FIG. 10 by nozzle-shaped, upwardly bent out sheet metal portions 41. It is also clear that by corresponding bevelling of the side walls insertion can be further improved. The cover and connecting plate are interconnected by rivet points 42. These could be standard rivets or tongues stamped from one material and wrapped round behind the other. However, it is advantageous to use a rivet connection method known under the trademark TOX. According to the latter a rivet point is formed in the two superimposed materials by a special design of a male and a female member and the cross-section of the rivet point can be gathered from FIG. 8. This leads to two corresponding, interengaging stampings, which are positively interconnected by lateral material flow.

FIG. 4 shows three of these rivet points, which are located on either side of the openings 26,27 and have a large base width for good fixing purposes. By the connection of the cover and the connecting plate simultaneously the passage means 25 is positively fixed in both directions.

In the case of a corresponding design, e.g. by interchanging the hole shapes between the cover and the connecting plate, the passage means could also be fitted from below in the same way. The passage means could also be differently constructed in other ways. It is important that on it there are two areas with oppositely directed support shoulders, insertion being possible up to the shoulder 33,36 in the insertion direction (direction of the central axis 43 of the passage means).

The further fitting and assembly is then very simple. The assembly unit comprising the cover 14, connecting plate 20 and the passage means 25 enclosed and fixed by the latter can be supplied as an entity to the electric hotplate and can optionally be automatically threaded over the then raised connecting leads 23, which are subsequently bent over. This procedure is particularly suitable for arrangements in which the connecting leads 23 only project slightly through the passage means 25 and are e.g. connected there by welding with laterally directed connecting leads.

Figure 11:
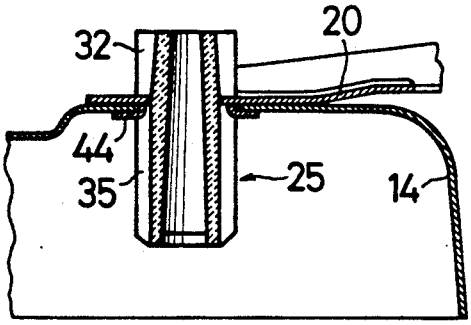
Figure 12:
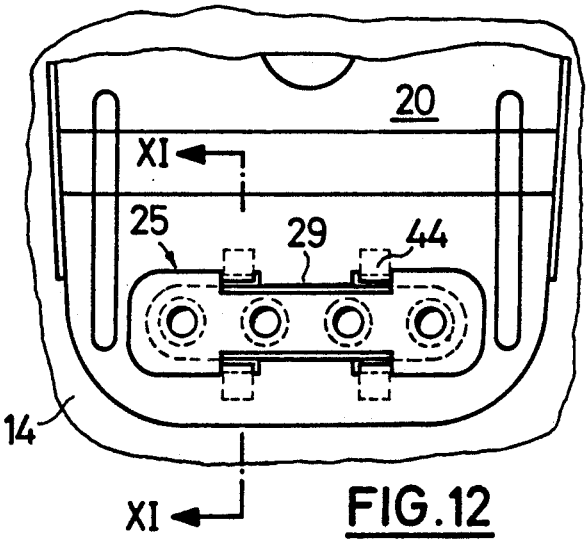

FIGS. 11 and 12 show a construction, which in principle and in basic form corresponds to those described hereinbefore. However, in this case the connection between the cover and the connecting plate is brought about by sheet metal tongues 44, which are made from material left standing and projecting into the opening 27. The same shape of passage means 25 can be used. In the area between the projections 32 and 35, where there are no support shoulders, the two sheet metal tongues 44 are passed through, whereby in the assembly state according to FIG. 11 they would be directed vertically downwards and would be wrapped over in the represented form. This connecting procedure also requires no extraneous materials. However, it would also be possible to provide the tongues on the cover 14, so that they would then be bent over on the top side in the drawings.

Figure 13:
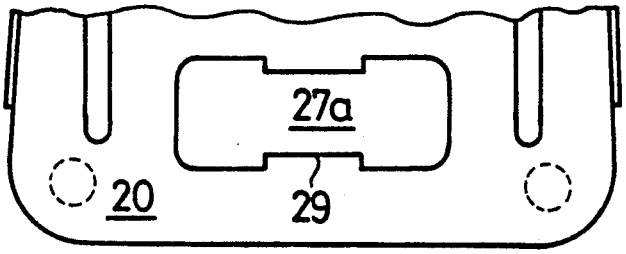
Figure 14:
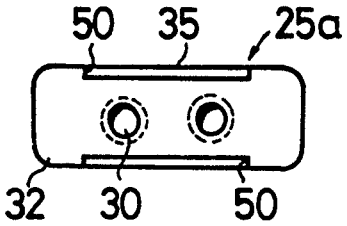
Figure 2:
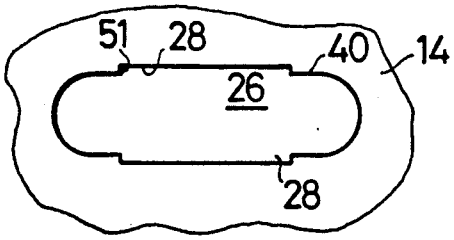
Figure 5:
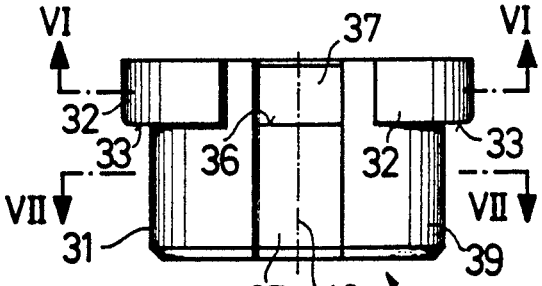
Figure 3:
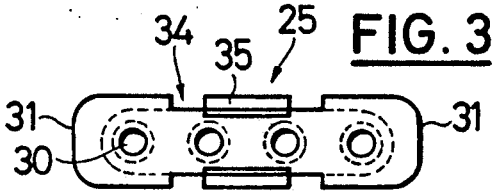
Figure 6:
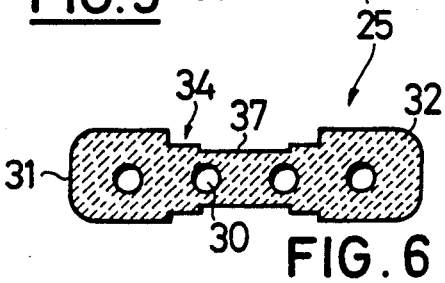

FIGS. 13 and 14 show that the fixing of the passage means is size-variable. In the case of a passage means 25*a* according to FIG. 4, which only has two passage holes 30 and is correspondingly much shorter, it is still possible to use the cover plate used for the construction with four passage holes and which therefore has an opening 26 according to FIG. 2. For a correspondingly shorter construction it is merely necessary to bear in mind that the projection 35 is sufficiently wide for its outer edges 50 to be guided on the outer edges 51 of the cutout 28 in FIG. 2. Thus, despite a much smaller width there is a satisfactory guidance of the passage means in the opening 26, the flange 32 being located on the upper surface. The connecting plate 20 has a cutout 27*a* (FIG. 13), whose shape and size are adapted to the passage means 25*a* of FIG. 14. The length of the projections 29 is unimportant here, because on engaging the connecting plate 20 guidance takes place by the outer edges of the flange 32.

It can be seen that this fixing method is very variable and permits the fitting of the most varied passage means in the same cover plate, which reduces the multiplicity of types necessary. The guidance in the cover or connecting plate consequently does not necessarily have to be taken over by the outer shape of the passage means and use can instead be made of internal guidance means, such as the edges 50,51. The cover plate 20 according to the FIG. 13 in this case covers the larger opening 26 in the cover 14.

I claim:

1. An electric hotplate comprising:

a cover fitted to the underside of the hotplate;

connecting plate means fitted to the cover and projecting laterally away from the hotplate, the connecting plate being adapted to be fitted with the connecting means; and passage means passing through openings in the cover and the connecting plate, the passage means being interlockingly fixed in all directions by the cover and the connecting plate means, whereby said passage means cannot move relative to said cover and said connecting plate means.

2. Hotplate according to claim 1, wherein the cover, the connecting plate means and the passage means are adapted to be combined to form a cohesive subassembly.

3. Hotplate according to claim 1, wherein the passage means is positively supported on the cover in a direction substantially at right angles to the cover and in the opposite direction on the connecting plate.

4. Hotplate according to claim 1, wherein the passage means is an insulator with passage openings for connecting leads of the hotplate.

5. Hotplate according to claim 1, wherein the connecting plate means and the cover are fixed to each other by at least one rivet joint.

6. Hotplate according to claim 5, wherein the rivet joint uses material of the parts to be connected as connecting material.

7. Hotplate according to claim 1, wherein sheet metal portions for guiding and engaging on the passage means are provided on at least one of the cover and connecting plate and bent away therefrom approximately perpendicularly.

8. An electric hotplate comprising:

a cover fitted to the underside of the hotplate;

connecting plate means fitted to the cover and projecting laterally away from the hotplate, the connecting plate being adapted to be fitted with connecting means; and passage means passing through openings in the cover and the connecting plate, the passage means being interlockingly fixed relative to all sides by the cover and the connecting plate means, wherein the passage means comprises two sets of support shoulders each of which sets points in opposite directions to each other.

9. Hotplate according to claim 8, wherein the support shoulders are provided on projections located on an outer face of the passage means and are reciprocally displaced in the circumferential direction of the passage means.

10. Hotplate according to claim 8, wherein the passage means being shaped as an elongated body with longitudinal and narrow sides, a flange-like projection being provided in the area of each of its narrow sides, each flange-like projection having a lateral support shoulder for being supported on the cover; a rib-like projection being provided substantially centrally on each of the longitudinal sides on each of which rib-like projections a central support shoulder is located directed in opposition to the lateral support shoulder.

11. Hotplate according to claim 10, wherein all said support shoulders are located substantially in one plane.

12. Hotplate according to claim 1, wherein the connection takes place by bending sheet metal tongues provided on at least one of the cover and the connecting plate.

* * * * *